US006734754B2

(12) United States Patent
Saito et al.

(10) Patent No.: US 6,734,754 B2
(45) Date of Patent: May 11, 2004

(54) NONRECIPROCAL CIRCUIT DEVICE HAVING A PROTRUDING ELECTRODE

(75) Inventors: Kenji Saito, Ishikawa-ken (JP); Masayuki Yoneda, Ishikawa-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 52 days.

(21) Appl. No.: 10/274,859

(22) Filed: Oct. 22, 2002

(65) Prior Publication Data

US 2003/0085769 A1 May 8, 2003

(30) Foreign Application Priority Data

Nov. 6, 2001 (JP) ..... 2001-341031

(51) Int. Cl.[7] ..... H01P 1/36; H01P 1/383
(52) U.S. Cl. ..... 333/24.2; 333/1.1
(58) Field of Search ..... 333/1.1, 24.2

(56) References Cited

U.S. PATENT DOCUMENTS 6,462,628 B2 * 10/2002 Kondo et al. ..... 333/24.2

FOREIGN PATENT DOCUMENTS

| | | |
|---|---|---|
| EP | 1 139 486 A1 | 10/2001 |
| JP | 5-304404 | 11/1993 |
| JP | 8-8610 | 1/1996 |
| JP | 9-55607 | 2/1997 |
| JP | 2000-49508 | 2/2000 |
| JP | 2001-136006 | 5/2001 |

OTHER PUBLICATIONS

Schloemann E F: "Circulators for Microwave and Millimiter–Wave Integrated Circuits"; Proceedings of the Institute of Radio Engineers, IEEE Inc; New York, USA; vol. 76, No. 2, Feb. 1988; pp. 188–200.

* cited by examiner

*Primary Examiner*—Benny Lee
*Assistant Examiner*—Stephen E. Jones
(74) *Attorney, Agent, or Firm*—Keating & Bennett, LLP

(57) ABSTRACT

A nonreciprocal circuit device includes a metal casing (upper and lower casing members), a permanent magnet, a center electrode assembly, and a multilayer substrate. The multilayer substrate has terminal electrodes that protrude therefrom and includes a resistance element and matching capacitor elements. The terminal electrodes of the multilayer substrate are fabricated by providing through holes in constraining layers and, after firing, removing the constraining layers except for the through holes. The bottom section of the lower metal casing member is arranged among the terminal electrodes. A ground electrode that covers substantially the entire lower surface of the multilayer substrate is electrically connected to the bottom section of the lower metal casing member. The height of the protrusions of the terminal electrodes extending from the lower surface of the multilayer substrate is substantially equal to a thickness (about 0.1 mm to about 0.2 mm) of the lower metal casing member.

17 Claims, 11 Drawing Sheets

NONRECIPROCAL CIRCUIT DEVICE HAVING A PROTRUDING ELECTRODE

BACKGROUND OF THE INVENTION

1. Field of the Invention

The present invention relates to a nonreciprocal circuit device and a communication apparatus including a nonreciprocal circuit device.

2. Description of the Related Art

An isolator disclosed in Japanese Unexamined Patent Application Publication No. 2001-136006 is known as a conventional isolator. As shown in FIG. 12, an isolator 200 includes an upper metal casing member 201, a permanent magnet 202, a center electrode assembly 203, a multilayer substrate 204, an external-connection terminal component 205, and a lower metal casing member 207. Reference symbol R indicates a resistance element. The center electrode assembly 203 and the multilayer substrate 204 are accommodated in the external-connection terminal component 205, and on the upper surface of the structure, the resistance element R and the permanent magnet 202 are arranged. The permanent magnet 202, the center electrode assembly 203, the multilayer substrate 204, the external-connection terminal component 205, and the resistance element R are then accommodated in the upper metal casing member 201 and the lower metal casing member 207, thereby defining a nonreciprocal circuit. In this case, to connect external-connection terminals 209 of the external-connection terminal components 205 to a mounting substrate, a groove 206, which has substantially the same depth as the thickness of the bottom section 208 of the lower metal casing member 207, is formed at the lower surface of the external-connection terminal component 205.

Since the isolator 200 requires the external-connection terminal component 205 as an individual component for connecting the external-connection terminals 209 to a mounting substrate, the cost of the isolator 200 is increased.

Another isolator disclosed in Japanese Unexamined Patent Application Publication No. 5-304404 is also known. As shown in FIG. 13, an isolator 300 includes a metal casing 301, a permanent magnet 307, a multilayer substrate 303 having a center electrode assembly therein, and a ferrite element 305. Side surfaces of the multilayer substrate 303 are provided with external-connection terminals 306 for connection with a mounting substrate. The isolator 300 is constructed such that the permanent magnet 307 and the ferrite element 305 are accommodated in the multilayer substrate 303, and the resulting structure is inserted into the metal casing 301. In this case, the lower portion 302 of the metal casing 301 fits into a groove 304 of the multilayer substrate 303. Thus, the multilayer substrate 303 has a cavity structure.

An isolator disclosed in Japanese Unexamined Patent Application Publication No. 9-55607 is also known as having a structure similar to that of the isolator 300.

For such an isolator 300, it has been difficult to manufacture such a multilayer substrate 303, which is obtained by firing and has a cavity structure with a large hole in the center thereof, with high accuracy at a low cost.

SUMMARY OF THE INVENTION

In order to overcome the problems described above, preferred embodiments of the present invention provide a nonreciprocal circuit device and a less-expensive communication apparatus with a reduced number of components.

According to a preferred embodiment of the present invention, a nonreciprocal circuit device includes (a) a permanent magnet;

(b) a center electrode assembly that includes a ferrite element, to which a direct-current magnetic field is applied by the permanent magnet, and a plurality of center electrodes, arranged on a major surface of the ferrite element;

(c) a multilayer substrate that has a first major surface and a second major surface opposing the first major surface and that includes matching capacitor elements connected to corresponding ends of the center electrodes, in which the center electrode assembly is arranged on the first major surface and a plurality of external-connection terminal electrodes is provided at the second major surface; and (d) a metal casing that encloses the permanent magnet, the center electrode assembly, and the multilayer substrate; and (e) the metal casing is partially provided on the second major surface of the multilayer substrate, and at least one of the plurality of external-connection terminal electrodes protrudes from the second major surface by an amount measurement that is substantially equal to the thickness of the metal casing. In this case, preferably, the height of the protrusion of the external-connection terminal electrode from the second major surface is in the range of about 0.1 mm to about 0.2 mm.

Preferred embodiments of the present invention, therefore, can provide the terminals with sufficient flatness, and the user can directly solder the external-connection terminal electrodes of the multilayer substrate to a mounting substrate, which can eliminate an external-connection terminal component that has been conventionally required. In addition, this arrangement can eliminate the need for forming a large hole in the center of the multilayer substrate, so that the multilayer substrate can be fired in a plate state, thereby suppressing the deformation of the multilayer substrate and increasing the dimensional accuracy thereof. This further offers advantages in that the dimensional accuracy of the multilayer substrate is increased and the fabrication process of the multilayer substrate can be greatly simplified, which therefore can provide a high-performance and less-expensive nonreciprocal circuit device.

Preferably, the at least one external-connection terminal electrode that protrudes from the second major surface by an amount that is a substantially equal to the thickness of the metal casing fits into a notch provided in the metal casing. With this arrangement, the multilayer substrate and the metal casing can be easily positioned.

Preferably, the second major surface of the multilayer substrate has a ground electrode arranged to cover substantially the entire second major surface and the ground electrode is electrically connected to the metal casing. This arrangement allows for a sufficient contact area between the ground electrode and the metal casing, thus improving the electrical characteristic of the nonreciprocal circuit device.

The external-connection terminal electrodes that protrude from the second major surface by an amount that is substantially equal to the thickness of the metal casing may be only an input terminal electrode and an output terminal electrode. In this case, the ground terminal electrode is soldered to the mounting substrate via the metal casing. Since the area of the interface at which the metal casing and the mounting substrate are joined is large, this arrangement can improve the mounting strength of the nonreciprocal circuit device. Further, the majority of thermal stress and mechanical stress is applied to an interface at which the metal casing and the mounting substrate are joined, thereby alleviating the stress applied to the interface between the input and output terminal electrodes and the mounting substrate. This also can improve reliability in the connection of the input and output terminal electrodes.

A second preferred embodiment of the present invention provides a communication apparatus. The communication apparatus includes the nonreciprocal circuit device constructed according to the preferred embodiment described above. Thus, the communication apparatus offers the same advantages as those of the nonreciprocal circuit device according to other preferred embodiments of the present invention, thus allowing for a reduction in the manufacturing cost and an improvement in the electrical characteristic.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
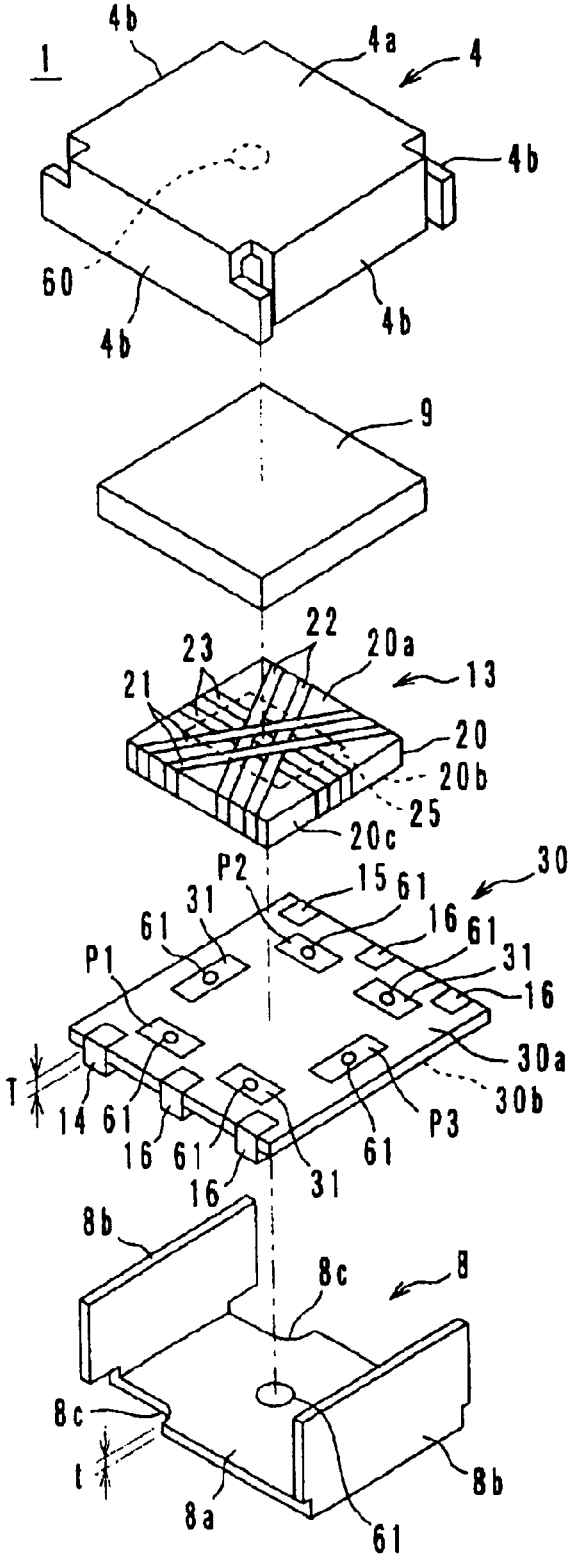
FIG. 1 is an exploded perspective view of a nonreciprocal circuit device according to a first preferred embodiment of the present invention.

A nonreciprocal circuit device and a communication apparatus according to preferred embodiments of the present invention will be described below with reference to the accompanying drawings. In each preferred embodiment, similar components and similar portions are denoted with the same reference numerals and the description thereof will be omitted.

First Preferred Embodiment

A first preferred embodiment of the present invention will now be described with reference to FIGS. 1 to 8. FIG. 1 is an exploded perspective view of a nonreciprocal circuit device according to a first preferred embodiment of the present invention. A nonreciprocal circuit device 1 is preferably a lumped-element isolator. As shown in FIG. 1, the lumped-element isolator 1 generally includes a metal casing that is constituted by an upper metal casing member 4 and a lower metal casing member 8, a permanent magnet 9, a center electrode assembly 13 that is constituted by a substantially rectangular microwave ferrite element 20 and center electrodes 21 to 23, and a substantially rectangular multilayer substrate 30. The multilayer substrate 30 has terminal electrodes 14 to 16 that protrude therefrom and includes a resistance element R and matching capacitor elements C1 to C3 (see FIG. 4).

The upper metal casing member 4 has a substantially box shaped configuration with one open end, and has an upper section 4*a* and four side sections 4*b*. The lower metal casing member 8 has left and right side sections 8*b* and a bottom section 8*a*. The bottom section 8*a* of the lower metal casing member 8 is provided with notches 8*c* for preventing the lower metal casing member 8 from contacting the terminal electrodes 14 and 15 of the multilayer substrate 30, which will be described later. The upper metal casing member 4 and the lower metal casing member 8 are preferably made of a ferromagnetic material, such as soft iron, to provide a magnetic circuit, and the surfaces of the upper metal casing member 4 and the lower metal casing member 8 are plated with Ag or Cu. Typically, the thickness t of each of the upper metal casing member 4 and the lower metal casing member 8 is about 0.1 mm to about 0.2 mm.

The permanent magnet 9 preferably has a substantially plate-like, substantially rectangular shape. An element for use as the permanent magnet 9 may be magnetized before being incorporated in the isolator 1, or may be magnetized after being incorporated in the isolator.

Figure 2:
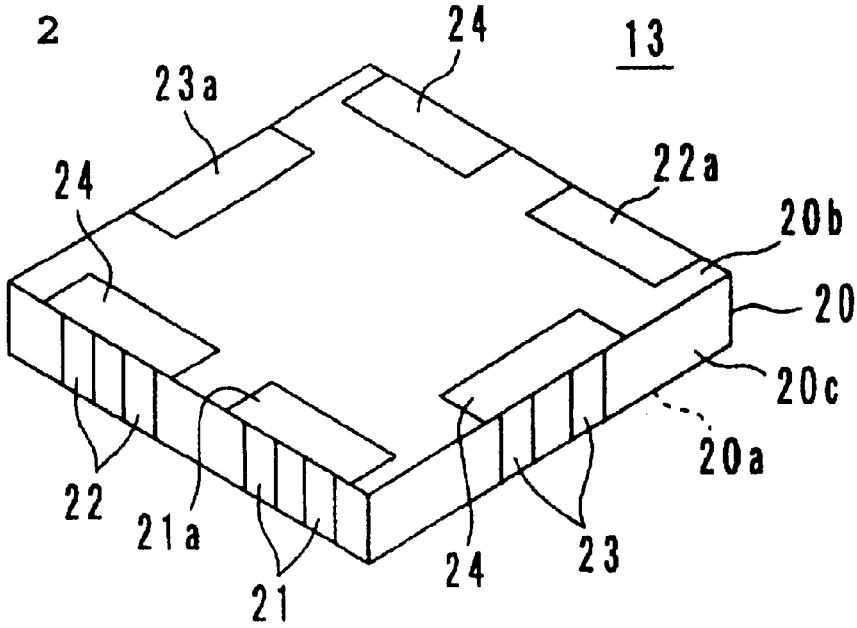
FIG. 2 is a perspective view of a center electrode assembly of the nonreciprocal circuit device shown in FIG. 1.

The center electrode assembly 13 is configured such that three center electrodes 21 to 23 are arranged on the upper surface 20*a* of the ferrite element 20 so as to cross one another by substantially 120° with insulating layers 25 interposed therebetween. In the first preferred embodiment, each of the center electrodes 21 to 23 is configured with two lines. The center electrodes 21 to 23 may be arranged in any order (see FIGS. 9 and 10), and, in this preferred embodiment, the center electrode 23, the insulating layer 25, the center electrode 22, the insulating layer 25, and the center electrode 21 are arranged in that order on the upper surface 20*a* of the ferrite element 20. As shown in FIG. 2, these center electrodes 21 to 23 are connected via side surfaces 20*c* of the ferrite element 20 to corresponding cold-side electrodes 24 that are provided on the lower surface 20*b* of the ferrite element 20, and the other ends of the center electrodes 21, 22 and 23 are connected via the side surfaces 20*c* to respective hot-side electrodes 21*a*, 22*a*, and 23*a* that are provided on the lower surface 20*b* of the ferrite element 20.

A photosensitive conductive paste material including Ag or Cu may be used for the center electrodes 21 to 23, the cold-side electrodes 24, and the hot-side electrodes 21*a*, 22*a*, and 23*a*.

Figure 3:
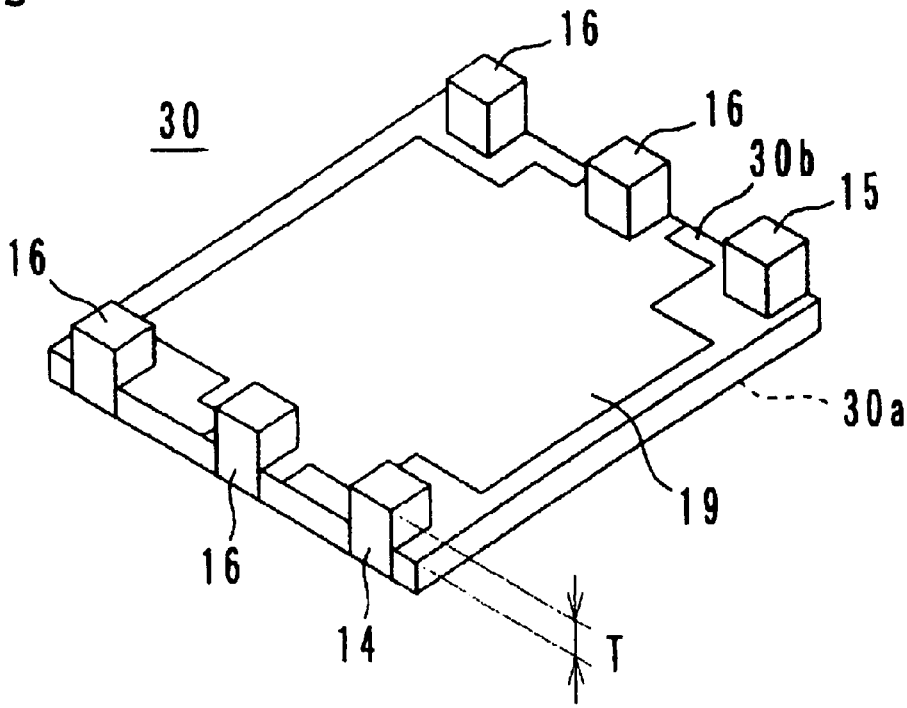
FIG. 3 is a perspective view of a multilayer substrate of the nonreciprocal circuit device shown in FIG. 1.
Figure 4:
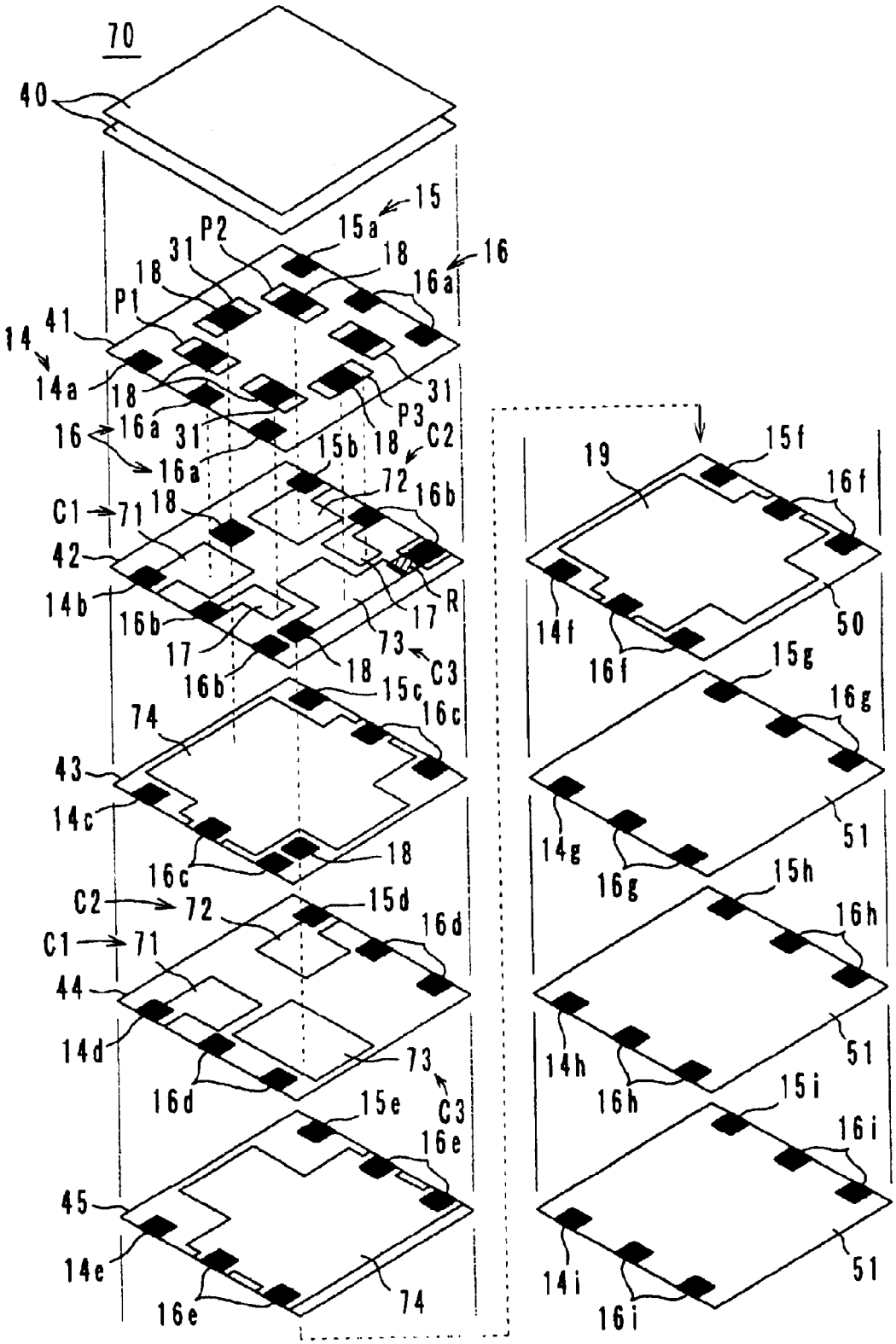
FIG. 4 is an exploded perspective view illustrating a manufacturing process of the multilayer substrate of the nonreciprocal circuit device shown in FIG. 1.

Port electrodes P1 to P3 and cold electrodes 31 are exposed at the upper surface 30*a* of the multilayer substrate 30. As shown in FIG. 3, at the lower surface 30*b* of the multilayer substrate 30, an input terminal electrode 14, an output terminal electrode 15, and ground terminal electrodes 16 are provided at the opposing side surfaces in a protruding manner for electrically connecting the isolator 1 to an external circuit. The thickness T of the protrusions, i.e., the height of the protrusions of the terminal electrodes 14 to 16 from the lower surface 30*b*, is preferably substantially equal to the thickness t of the lower metal casing member 8. A metal-casing-connection ground electrode 19 for connection with the bottom section 8*a* of the lower metal casing member 8 is provided on substantially the entire lower surface 30*b*, except in the vicinities of the input terminal electrode 14 and the output terminal electrode 15, of the multilayer substrate 30. As shown in FIG. 4, the multilayer substrate 30 includes the matching capacitor elements C1 to C3, which are constituted by hot-side capacitor electrodes 71 to 73 and cold-side capacitor electrodes 74, and the resistance element R. The multilayer substrate 30 is preferably an LTCC (low temperature cofired ceramic) multilayer substrate.

Figure 5:
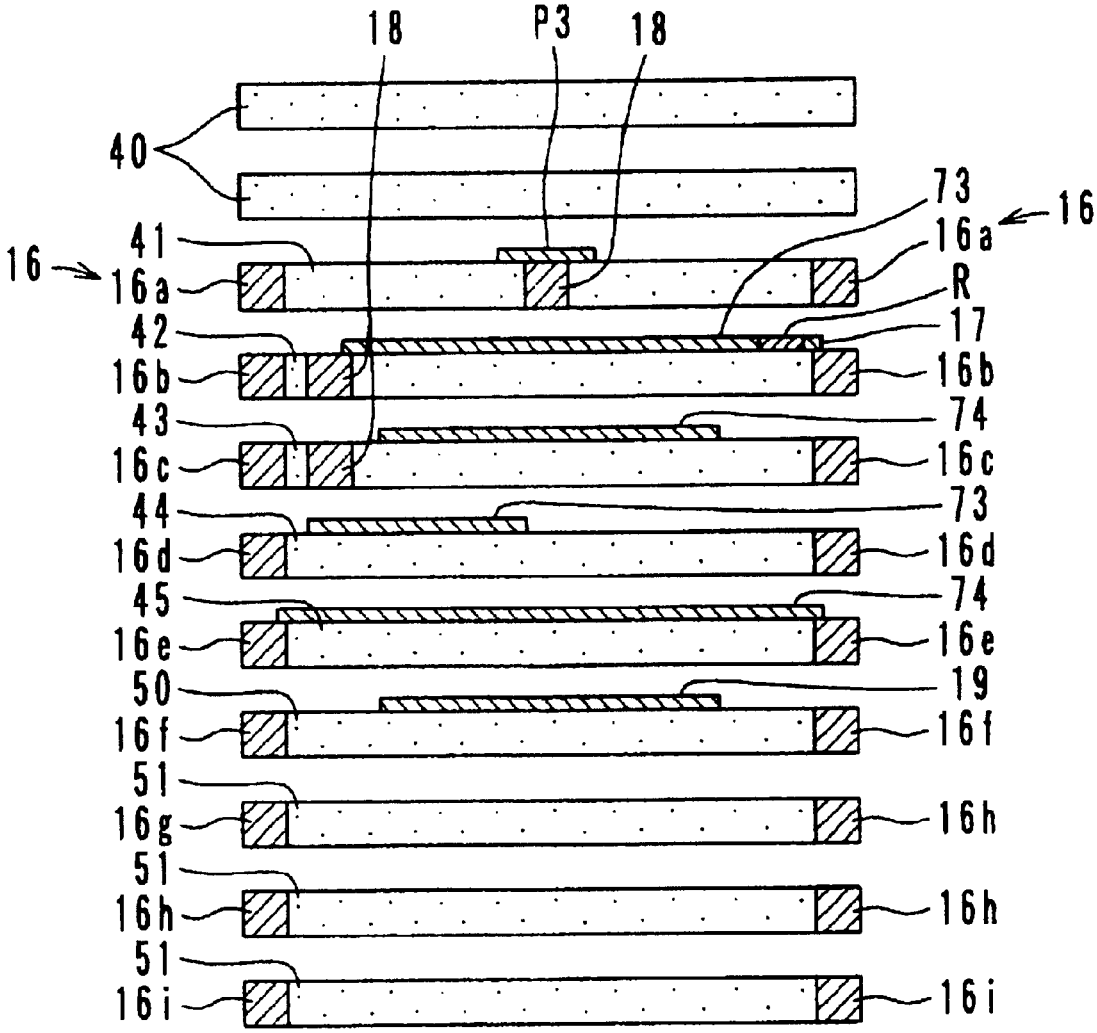
FIG. 5 is a vertical sectional view illustrating a manufacturing process, which follows FIG. 4, of the multilayer substrate.
Figure 6:
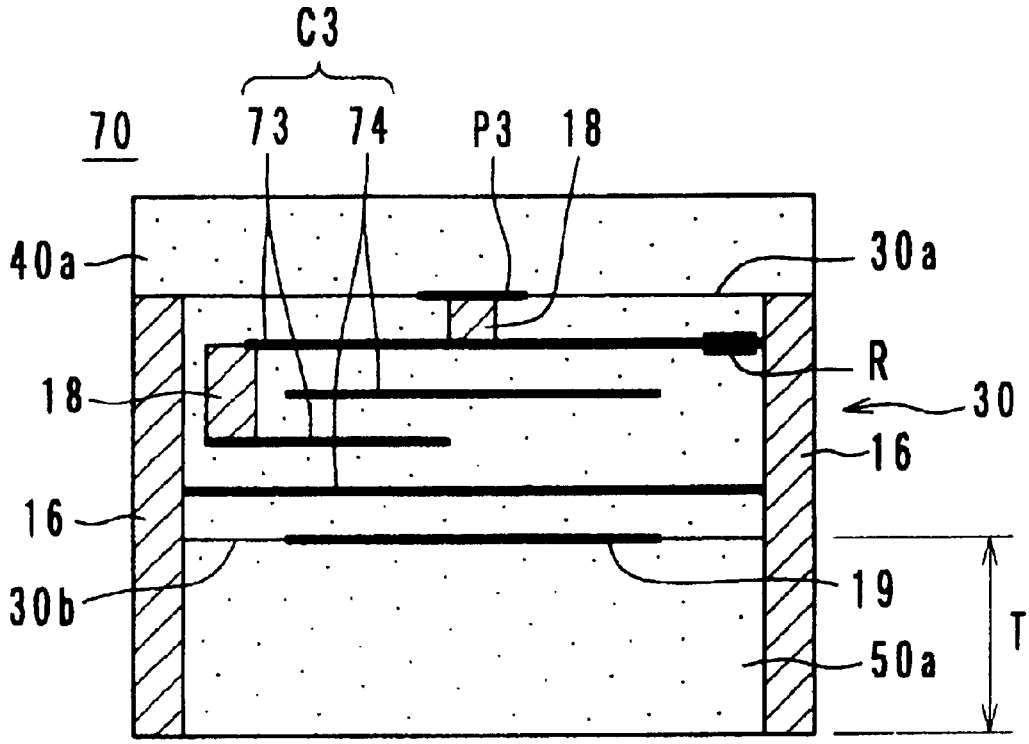
FIG. 6 is a vertical sectional view illustrating a manufacturing process, which follows FIG. 5, of the multilayer substrate.

This multilayer substrate 30 may be provided, for example, in the following manner. As shown in FIGS. 4 to 6, the multilayer substrate 30 includes unsintered sheets 40, green sheets 41 to 45, a transcription sheet 50, and unsintered sheets 51. The unsintered sheets 40 are used as constraining layers, and the unsintered sheets 51 are used as constraining layers and have through holes 14*g* to 14*i*, 15*g* to 15*i*, and 16*g* to 16*i*. The green sheets 41 to 45 have the electrodes P1 to P3, 17, 31, and 71 to 74, through holes 14*a* to 14*e*, 15*a* to 15*e*, 16*a* to 16*e*, 18, and the like, and the transcription sheet 50 is used to transcribe the metal-casing-connection ground electrode 19 onto the lower surface 30*b* (i.e., the green sheet 45) of the multilayer substrate 30. The sheets 40, 50, and 51 are defined by sheets that do not sinter at the sintering temperature of the green sheets 41 to 45.

The green sheets 41 to 45 are preferably manufactured in the following manner. A solvent, a binder, and a plasticizer are added to a mixed power of a ceramic substrate material (about 60 weight percent of vitreous material and about 40 weight percent of alumina), and the resulting mixture is kneaded to provide a slurry, which is then fabricated into the green sheets 41 to 45 using a common doctor-blade method.

The unsintered sheets 40 and 51 are manufactured by forming a paste from a mixture of an alumina power and a binder and using a common doctor-blade method. The transcription sheet 50 is manufactured by adding a solvent, a binder, and a plasticizer to alumina powder, kneading the resulting mixture to provide a slurry, and using a common doctor-blade method. In this case, a material having a melting point higher than that of the material of the green sheets 41 to 45 is mainly used for the unsintered sheets 40 and 51 and the transcription sheet 50, which prevent the green sheets 41 to 45 from contracting in the inward direction at the time of sintering, thereby providing a high-accuracy multilayer substrate 30.

Next, as shown in FIG. 4, the green sheets 41 to 45, the transcription sheet 50, and the unsintered sheets 51 are provided with the through holes 14*a* to 14*i* for the input terminal electrode 14, the through holes 15*a* to 15*i* for the output terminal electrode 15, the through holes 16*a* to 16*i* for the ground terminal electrodes 16, and through holes 18 for communication. These through holes 14*a* to 14*i*, 15*a* to 15*i*, 16*a* to 16*i*, and 18 are necessary for providing connections between the individual sheets 41 to 51. The green sheets 41 to 45 and the transcription sheet 50 are further provided with the port electrodes P1 to P3, the cold electrodes 31, the capacitor electrodes 71 to 74, and the circuit electrodes 17. These electrodes P1 to P3, 17, 31, and 71 to 74 are disposed on the surfaces of the green sheets 41 to 45 and the transcription sheet 50 by screen printing, sputtering, deposition, lamination, plating, or other suitable process. The green sheet 42 has the resistance element R having a thick film, including cermet, carbon, or ruthenium. Ag, Pd, Cu, Au, Ag-Pd, or other suitable material may be used as a material for the electrodes P1 to P3, 17, 31, and 71 to 74.

As shown in FIG. 4, the through holes 14*a* to 14*i*, 15*a* to 15*i*, 16*a* to 16*i*, and 18, the electrodes P1 to P3, 17, 31, and 71 to 74, and the resistance element R constitute electrical circuits within the multilayer substrate 30. For example, the hot-side capacitor electrodes 71 to 73 and the cold-side capacitor electrodes 74 constitute the matching capacitor elements C1 to C3. The through holes 14*a* to 14*i*, 15*a* to 15*i*, and 16*a* to 16*i*, which are provided in the sheets 41 to 45, 50, and 51, are stacked and thermally bonded to provide the input terminal electrode 14, the output terminal electrode 15, and the ground terminal electrodes 16, respectively.

Next, as shown in FIG. 5, the two unsintered sheets 40, the green sheets 41 to 45, the transcription sheet 50, and the three unsintered sheets 51 are stacked in that order and are thermally bonded. As a result, the unsintered sheets 40, the transcription sheet 50, and the unsintered sheets 51, which are shown in FIG. 5, turn into constraining layers 40*a* and 50*a*, as shown in FIG. 6. Similarly, the through holes 14*a* to 14*i*, 15*a* to 15*i*, and 16*a* to 16*i*, which are shown in FIG. 5, of the sheets 41 to 45, 50, and 51 are respectively integrated into the input terminal electrode 14, the output terminal electrode 15, and the ground terminal electrodes 16, which have a parallelepiped shape, as shown in FIG. 6. As a result, a laminate 70 is provided. The terminal bonding conditions are such that the temperature is preferably about 80° C., the pressure is about 100 MPa, and the thermal bonding time is about 1 minute, for example.

The laminate 70 is configured such that the constraining layer 40*a* and the constraining layer 50*a* sandwich the multilayer substrate 30 having a substantially parallelepiped shape. The through hole 18 for communication and the conductor patterns (i.e. hot-side capacitor electrodes) 73 are connected by thermal bonding to provide an electrical circuit (see FIG. 8) within the multilayer substrate 30. The metal-casing-connection ground electrode 19, which is disposed on the transcription sheet 50, is transcribed onto the lower surface 30*b* of the multilayer substrate 30.

Next, the constraining layers 40*a* and 50*a* are released and removed from the laminate 70 by brushing or other suitable process, leaving the input terminal electrode 14, the output terminal electrode 15, and the ground terminal electrode 16, to provide the multilayer substrate 30 as shown in FIGS. 1 and 3. The thickness T of the terminal electrodes 14 to 16, i.e., the height of the protrusions of the terminal electrodes 14 to 16 from the lower surface 30*b* of the multilayer substrate 30, is preferably substantially equal the thickness t of the bottom section 8*a* of the lower metal casing member 8. The portion among the terminal electrodes 14 to 16, which was filled with the constraining layer 50*a* and from which the constraining layer 50*a* has been removed, is used as a portion into which the bottom section 8*a* fits, as described later. To improve the solderability, the terminal electrodes 14 to 16 may be subjected to plating of Ni, Au, or other suitable process.

The constituting components described above are constructed in the following manner. Solder and adhesive are used for assembling the components. That is, as shown in FIG. 1, an adhesive 60 is applied to the lower surface of the upper section 4*a* of the upper metal casing member 4 to secure the permanent magnet 9. The center electrode assembly 13 and the multilayer substrate 30 are electrically connected with each other by solder 61 provided on the cold electrodes 31 and the port electrodes P1 to P3. Further, the center electrode assembly 13 and the multilayer substrate 30 may be secured by, for example, an adhesive using an underfilling method. This can improve the mechanical strength of the isolator 1.

The metal-casing-connection ground electrode 19, which is provided on the lower surface 30*b* of the multilayer substrate 30, is electrically connected to the bottom section 8*a* of the lower metal casing member 8 by solder 61. In this case, the metal-casing-connection ground electrode 19 is arranged so as to correspond to substantially the entire surface of the bottom section 8*a* of the lower metal casing member 8, so that the metal-casing-connection ground electrode 19 and the lower metal casing member 8 can be provided with sufficient grounding. This arrangement, therefore, can greatly improve the electrical characteristic of the isolator 1.

The side sections 8*b* of the lower metal casing member 8 and the side sections 4*b* of the upper metal casing member 4 are joined with solder or other suitable material to provide a metal casing. The metal casing also defines as a yoke, i.e., defines a magnetic path that encloses the permanent magnet 9, the center electrode assembly 13, and the multilayer substrate 30. The permanent magnet 9 also applies a DC (direct current) magnetic field to the ferrite element 20.

Figure 7:
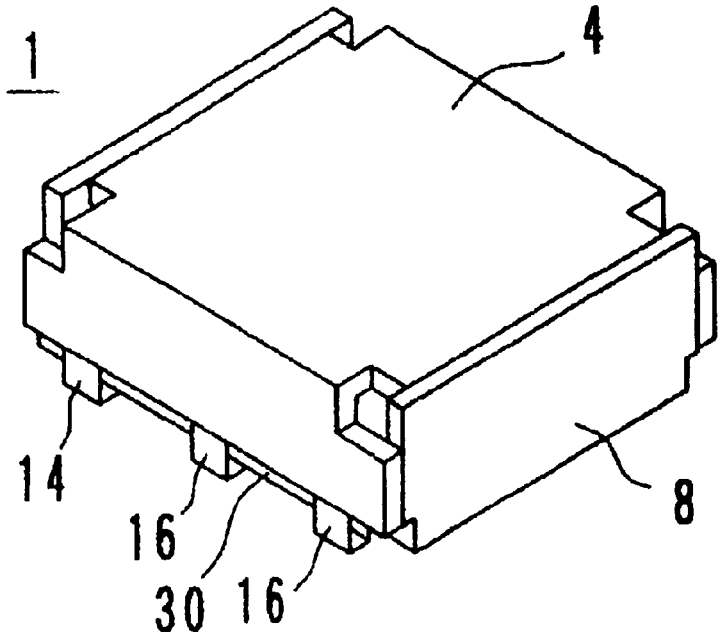
FIG. 7 is a perspective view after the assembling of the nonreciprocal circuit device shown in FIG. 1 is completed.
Figure 8:
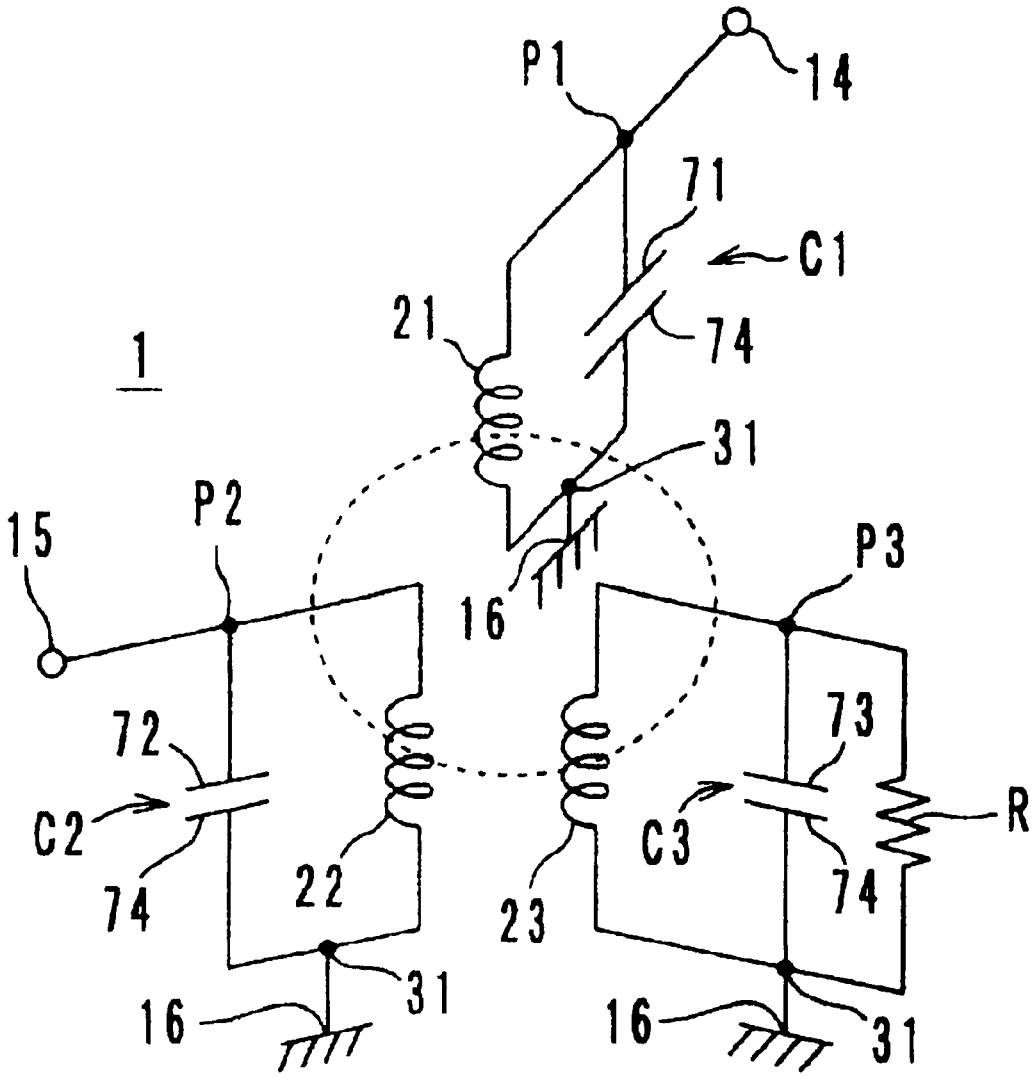
FIG. 8 is an electrical equivalent circuit diagram of the nonreciprocal circuit device shown in FIG. 7.

In that manner, the isolator 1 as shown in FIG. 7 is provided. FIG. 8 is an electrical equivalent circuit diagram of the isolator 1. As shown in FIGS. 6 and 8, the matching capacitor element C3, which is constituted by the capacitor electrodes 73 and 74, and the resistance element R are connected in parallel with each other between the port electrode P3 and the ground terminal electrode 16.

Figure 12:
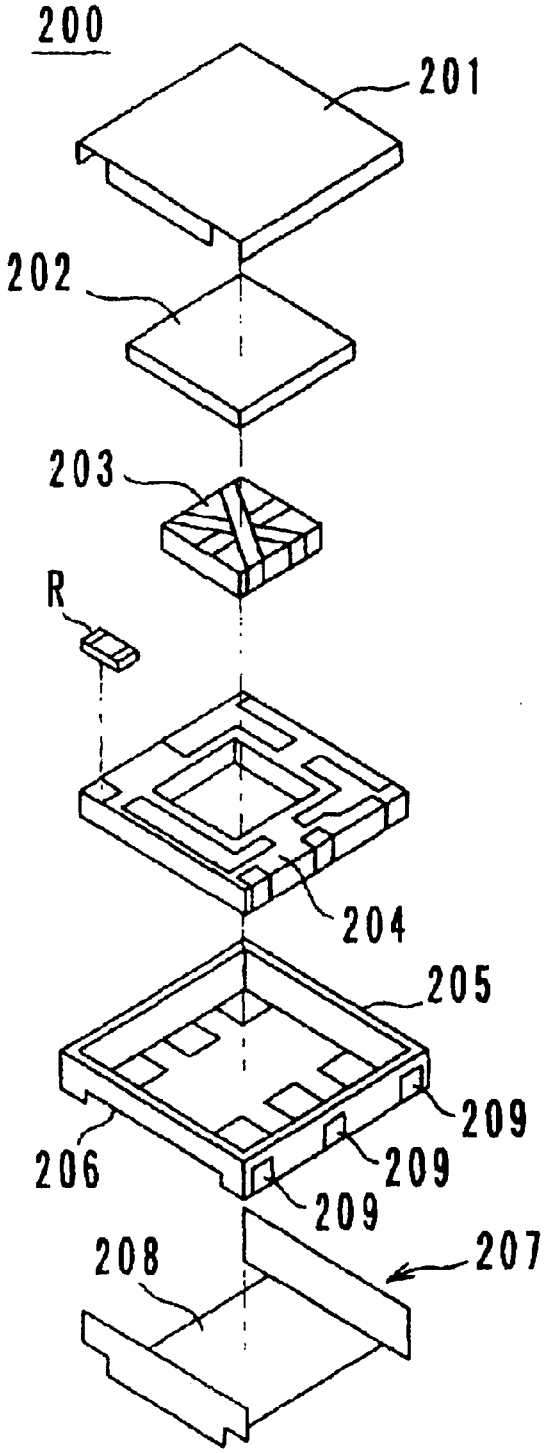
Fig. 12 PRIOR ART
FIG. 12 is an exploded perspective view of a conventional nonreciprocal circuit device.
Figure 13:
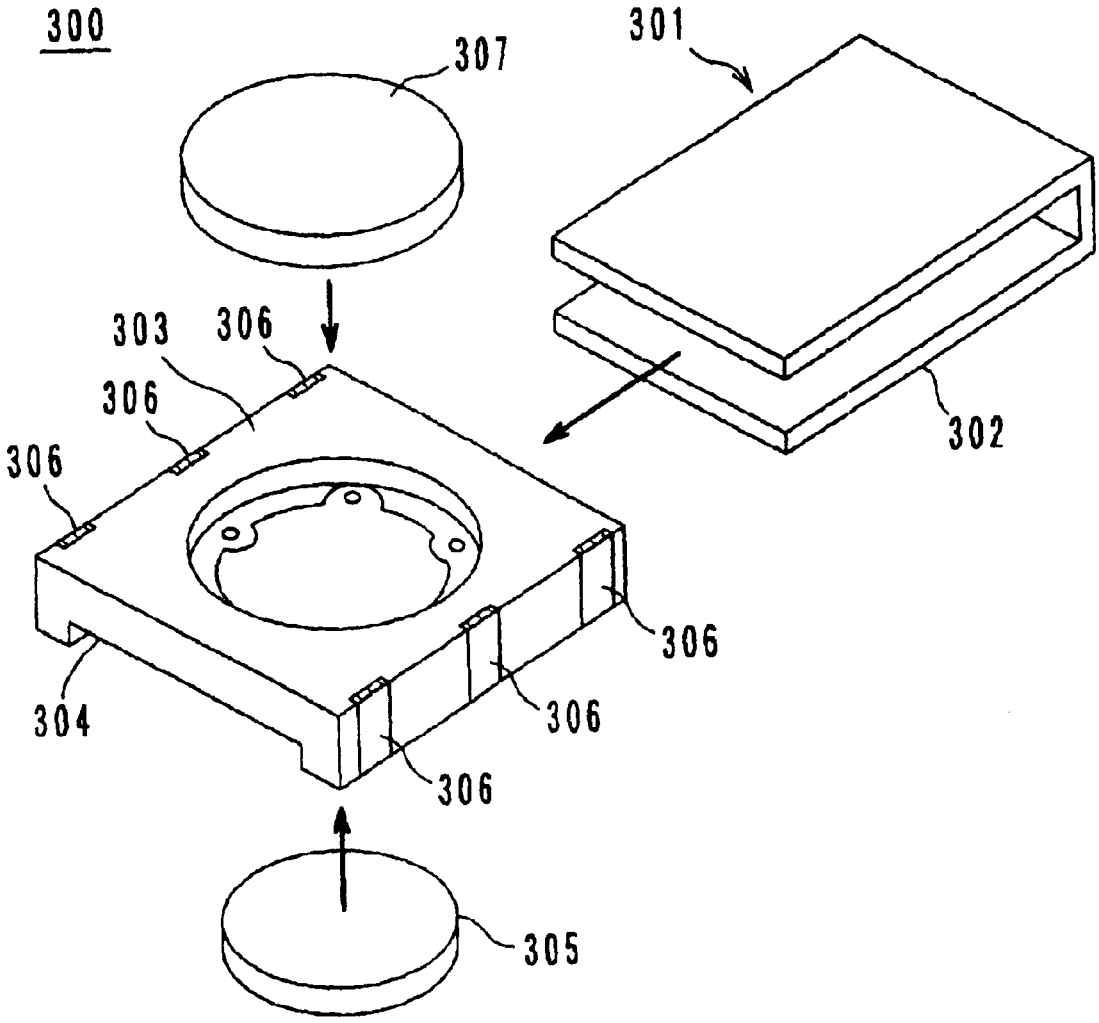
Fig. 13 PRIOR ART
FIG. 13 is an exploded perspective view of another conventional nonreciprocal circuit device.

Accordingly, the first preferred embodiment described above can eliminate the external-connection terminal component 205 of the conventional isolator 200 (see FIG. 12), thus allowing for a reduction in the component cost of the isolator 1. In addition, the first preferred embodiment can eliminate the need for forming a large hole in the center of the upper surface 30*a* and the lower surface 30*b* of the multilayer substrate 30, so that the multilayer substrate 30 can be fired in a plate state, thus allowing an improvement in the dimensional accuracy thereof. This arrangement, therefore, can provide a less-expensive isolator 1 having an improved electrical characteristic.

Second Preferred Embodiment

A second preferred embodiment will now be described with reference to FIG. 9. In the second preferred embodiment, the lower metal casing member 8 of the first preferred embodiment is shaped such that the ground terminal electrodes 16 of the multilayer substrate 30 fit thereinto.

Figure 9:
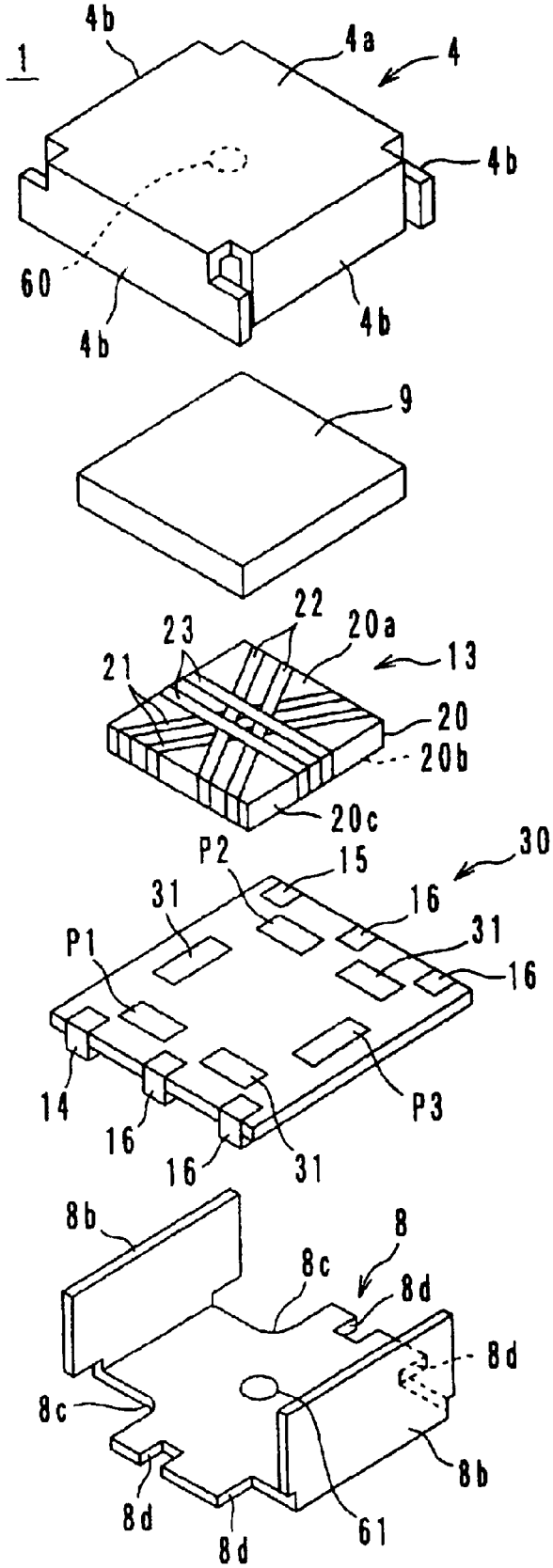
FIG. 9 is an exploded perspective view of a nonreciprocal circuit device according to a second preferred embodiment of the present invention.

As shown in FIG. 9, the bottom section 8*a* of the lower metal casing member 8 is preferably provided with four notches 8*d*. The ground terminal electrodes 16, which are provided at the lower surface 30*b* of the multilayer substrate 30, fit into the corresponding notches 8*d*.

The isolator 1 of the second preferred embodiment provides the same advantages as those of the first preferred embodiment. In addition, the multilayer substrate 30 and the lower metal casing member 8 can be easily positioned, thus allowing an improvement in the assembly workability of the isolator 1. This is because the ground terminal electrodes 16 that protrude from the lower surface 30*b* of the multilayer substrate 30 by an amount that is substantially equal to the thickness t of the lower metal casing member 8 fit into the corresponding notches 8*d* provided in the lower metal casing member 8.

Third Preferred Embodiment

A third preferred embodiment will now be described with reference to FIG. 10. In the third preferred embodiment, the notches 8*d* of the lower metal casing member 8 of the second preferred embodiment are not provided and the ground terminal electrodes 16 are embedded in the lower surface 30*b* of the multilayer substrate 30.

Figure 10:
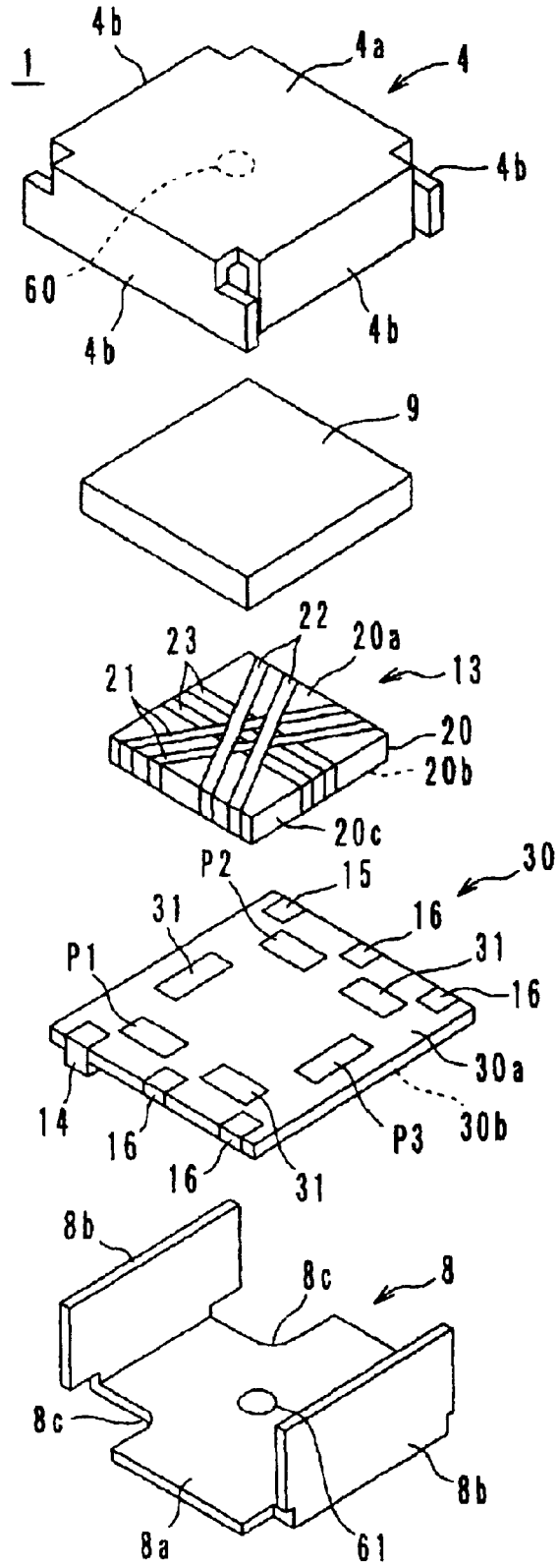
FIG. 10 is an exploded perspective view of a nonreciprocal circuit device according to a third preferred embodiment of the present invention.

As shown in FIG. 10, the multilayer substrate 30 of the third preferred embodiment has a configuration in which the ground terminal electrodes 16 do not protrude from the lower surface 30*b* of the multilayer substrate 30. For example, the external-connection terminal electrodes that protrude from the lower surface 30*b* by an amount that is substantially equal to the thickness t of the lower metal casing member 8 are the input terminal electrode 14 and the output terminal electrode 15. This multilayer substrate 30 can be provided by omitting the through holes 16*g* to 16*i*, of the unsintered sheets 51 (see FIG. 14), for the ground terminal electrodes 16 and forming only the through holes 14*g* to 14*i* and 15*g* to 15*i* for input and output terminal electrodes 14 and 15.

The lower surface 30*b* of the multilayer substrate 30 shown in FIG. 10 has a configuration such that the ground terminal electrodes 16 and the metal-casing-connection ground electrode 19 integrally cover substantially the entire surface of the lower surface 30*b*, except portions corresponding to the vicinities of the input terminal electrode 14 and the output terminal electrode 15. The bottom section 8*a* of the lower metal casing member 8 has substantially the same area as that of the lower section 30*b* of the multilayer substrate 30. The ground terminal electrodes 16 and the metal-casing-connection ground electrode 19 are connected to the upper surface of the bottom section 8*a* of the lower metal casing member B. The ground electrode of a mounting substrate (not shown) is soldered to a large area of the bottom section 8*a* of the lower metal casing member 8, and the input terminal electrode 14 and the output terminal electrode 15 are soldered to the input electrode and the output electrode of the mounting substrate, respectively. Thus, the ground terminal electrodes 16 and the metal-casing-connection ground electrode 19 of the multilayer substrate 30 are connected to the ground electrode of the mounting substrate via the lower metal casing member 8.

The isolator 1 of the third preferred embodiment provides the same advantages as those of the first preferred embodiment. In addition, since the area of the interface at which the lower metal casing member 8 and the mounting substrate are joined is large, the third preferred embodiment can improve the mounting strength of the isolator 1. Furthermore, the majority of thermal stress and mechanical stress which are generated when the isolator 1 is mounted to the mounting substrate is applied to the interface between the mounting substrate and the bottom section 8*a* of the lower metal casing member 8, thereby alleviating the stress applied to the interface between the input and output terminal electrodes 14 and 15 and the mounting substrate. This can greatly improve the reliability of the connection (i.e., in impact testing) of the input terminal electrode 14 and the output terminal electrode 15.

Fourth Preferred Embodiment

A fourth preferred embodiment will now be described with reference to FIG. 11. The fourth preferred embodiment of the present invention is directed to a communication apparatus and will be described in the context of an exemplary portable telephone.

Figure 11:
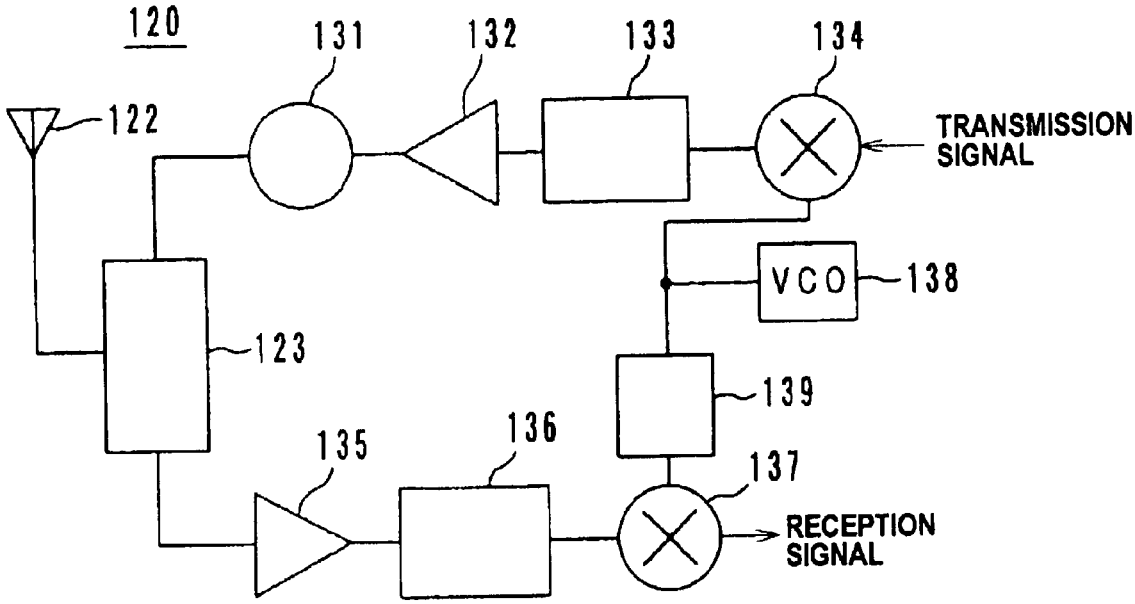
FIG. 11 is an electrical circuit block diagram of a communication apparatus according to a preferred embodiment of the present invention.

FIG. 11 is an electrical circuit block diagram showing an RF portion of a portable telephone 120. In FIG. 11, reference numeral 122 indicates an antenna element, 123 is a duplexer, 131 is a transmitting-side isolator, 132 is a transmitting-side-amplifier, 133 is a transmitting-side interstage bandpass filter, 134 is a transmitting-side mixer, 135 is a receiving-side amplifier, 136 is a receiving-side interstage bandpass filter, 137 is a receiving-side mixer, 138 is a voltage controlled oscillator (VCO), and 139 is a local bandpass filter.

The lumped-element isolator 1 according to any of the first to third preferred embodiments can be used as the transmitting-side isolator 131. Mounting the isolator 1 as the transmitting-side isolator 131 can achieve a portable telephone having an improved electrical characteristic at a low cost.

Other Preferred Embodiments

Modifications according to the present invention will now be described. The present invention is not limited to the specific preferred embodiments described above, and can take various forms within the spirit and scope of the present invention. For example, the detailed structures of the constituting components of the isolator 1 illustrated in the first to third preferred embodiments, i.e., of the upper metal casing member 4, the lower metal casing member 8, the center electrode assembly 13, the multilayer substrate 30, the ferrite element 20, and other elements, are arbitrary.

While the center electrodes 21 to 23 and other elements of the center electrode assembly 13 illustrated in the first to third preferred embodiments have been formed preferably using a photosensitive conductive paste material, the present invention is not limited thereto. Thus, they may be formed by stamping or etching a metal sheet made of conductive material to integrally form a center conductor (not shown) and winding the center conductor around the ferrite element 20. In this center conductor, three center electrodes extend from a ground electrode plate in a radial pattern. The ground electrode plate is arranged on the lower surface 20*b* of the ferrite element 20, and the three center electrodes are arranged on the upper surface 20*a* of the ferrite element 20 so as to cover the ferrite element 20 with an insulating sheet interposed therebetween. In the center electrode assembly obtained in that manner, the ends of the three center electrodes are electrically connected to the corresponding port electrodes P1 to P3 of the multilayer substrate, and the ground electrode plate is connected to the cold electrode 31.

While the isolator 1 illustrated in the first to third preferred embodiments has been described as being a three-port-type isolator, the present invention is not limited thereto and thus can be applied to a two-port-type isolator. While the crossing angle between the respective center electrodes 21 to 23 of the three-port-type isolator 1 illustrated in the first to third preferred embodiments has been described as being about 120°, the present invention is not limited thereto. For a three-port-type isolator, the crossing angle is may be, for example, in the range of about 90° to about 150°. For a two-port-type isolator, the crossing angle may be, for example, in the range of about 60° to about 120° (the typical crossing angle is about 90°).

In addition, while the metal casing of the isolator 1 illustrated in the first to third preferred embodiments has been described as being constituted by two casings, i.e., the upper metal casing member 4 and the lower metal casing member 8, the present invention is not limited thereto and the casing may be constituted by three or more casing members. The ferrite element 20 is not limited to a substantially rectangular shape in plan view, but may have any shape such as a circle or hexagon, or other suitable shape. The shape of the permanent magnet 9 may be substantially circularle, substantially triangulare with rounded corners, or other suitable shape, instead of substantially rectangular.

Additionally, with the isolator 1 illustrated in the first to third preferred embodiments, a circulator may be configured in the following manner. A terminal (not show) that is electrically connected to the port electrode P3 is provided in addition to the input terminal electrode 14, the output terminal electrode 15, and the ground terminal electrode 16, which are shown in FIG. 1, and the resistance element R is eliminated. Furthermore, the present invention is also applicable to various nonreciprocal circuit devices other than isolators and circulators.

In addition, while each of the center electrodes 21 to 23 in the first to third preferred embodiments has been described as having two lines, the present invention is not limited thereto. Thus, the number of lines of each of the center electrodes 21 to 23 may be one, or three or more. The numbers of lines of the center electrodes 21 to 23 do not have to be the same, and thus may be different from each other.

While the through holes 14*a* to 14*i*, 15*a* to 15*i*, 16*a* to 16*i*, and 18 have been described and shown as having a substantially rectangular shape in horizontal sectional view, the present invention is not limited thereto and thus the shape thereof may be substantially circular or substantially polygonal.

Additionally, while the communication apparatus according to the fourth preferred embodiment of the present invention has been described in the context of the exemplary portable telephone, the present invention is not limited thereto and thus can be applied to other communication apparatuses.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A nonreciprocal circuit device comprising:

a permanent magnet;

a center electrode assembly that includes a ferrite element, to which a direct-current magnetic field is applied by the permanent magnet, and a plurality of center electrodes, arranged on a major surface of the ferrite element;

a multilayer substrate that has a first major surface and a second major surface being opposed to the first major surface and that includes matching capacitor elements connected to corresponding ends of the center electrodes, wherein the center electrode assembly is arranged on the first major surface and a plurality of external-connection terminal electrodes is provided at the second major surface; and a metal casing that encloses the permanent magnet, the center electrode assembly, and the multilayer substrate;

wherein the metal casing is partially provided on the second major surface of the multilayer substrate and at least one of the plurality of external-connection terminal electrodes protrudes from the second major surface by a distance that is substantially equal to a thickness of the metal casing.

2. The nonreciprocal circuit device of claim 1, wherein said at least one external-connection terminal electrode that protrudes from the second major surface by a distance that is substantially equal to the thickness of the metal casing fits into a notch provided in the metal casing.

3. The nonreciprocal circuit device of claim 2, wherein the external-connection terminal electrodes that protrude from the second major surface by a distance that is substantially equal to the thickness of the metal casing include only an input terminal electrode and an output terminal electrode.

4. The nonreciprocal circuit device of claim 2, wherein the second major surface of the multilayer substrate has a ground electrode arranged to cover substantially the entire second major surface and the ground electrode is electrically connected to the metal casing.

5. The nonreciprocal circuit device of claim 4, wherein the distance of the protrusion of the external-connection terminal electrode from the second major surface is about 0.1 mm to 0.2 mm.

6. The nonreciprocal circuit device of claim 2, wherein the distance of the protrusion of the external-connection terminal electrode from the second major surface is about 0.1 mm to about 0.2 mm.

7. A communication apparatus comprising the nonreciprocal circuit device of claim 6.

8. A communication apparatus comprising the nonreciprocal circuit device of claim 2.

9. The nonreciprocal circuit device of claim 1, wherein the second major surface of the multilayer substrate has a ground electrode arranged to cover substantially the entire second major surface and the ground electrode is electrically connected to the metal casing.

10. The nonreciprocal circuit device of claim 9, wherein the distance of the protrusion of the external-connection terminal electrode from the second major surface is about 0.1 mm to about 0.2 mm.

11. A communication apparatus comprising the nonreciprcal circuit device of claim 10.

12. The nonreciprocal circuit device of claim 9, wherein the external-connection terminal electrodes that protrude from the second major surface by a distance that is substantially equal to the thickness of the metal casing include only an input terminal electrode and an output terminal electrode.

13. A communication apparatus comprising the nonreciprocal circuit device of claim 9.

14. The nonreciprocal circuit device of claim 1, wherein the distance of the protrusion of the external-connection terminal electrode from the second major surface is about 0.1 mm to about 0.2 mm.

15. A communication apparatus comprising the nonreciprocal circuit device of claim 14.

16. The nonreciprocal circuit device of claim 1, wherein the external-connection terminal electrodes that protrude from the second major surface by a distance that is substantially equal to the thickness of the metal casing include only an input terminal electrode and an output terminal electrode.

17. A communication apparatus comprising the nonreciprocal circuit device of claim 1.

* * * * *